US008764235B2

(12) United States Patent
Liu et al.

(10) Patent No.: US 8,764,235 B2
(45) Date of Patent: Jul. 1, 2014

(54) BUILDING MATERIAL AND BUILT-UP BUILDING MATERIAL STRUCTURE

(75) Inventors: Tzu-Wei Liu, Taichung (TW); Chian-Chi Huang, Taipei (TW); Min-Feng Huang, Taipei (TW)

(73) Assignee: Miniwiz S.E.D. Co., Ltd., Taipei (TW)

( * ) Notice: Subject to any disclaimer, the term of this patent is extended or adjusted under 35 U.S.C. 154(b) by 716 days.

(21) Appl. No.: 12/869,757

(22) Filed: Aug. 27, 2010

(65) Prior Publication Data

US 2011/0090693 A1 Apr. 21, 2011

(30) Foreign Application Priority Data

Oct. 16, 2009 (TW) ..... 98135106 A

(51) Int. Cl.

| | |
|---|---|
| ***F21S 4/00*** | (2006.01) |
| ***F21V 21/00*** | (2006.01) |
| ***E04C 2/32*** | (2006.01) |
| ***F21V 33/00*** | (2006.01) |
| ***E04C 2/20*** | (2006.01) |
| *F21Y 101/02* | (2006.01) |

(52) U.S. Cl.

CPC ..... *E04C 2/326* (2013.01); *F21V 33/006* (2013.01); *F21Y 2101/025* (2013.01); *F21Y 2101/02* (2013.01); *E04C 2/20* (2013.01)

USPC ..... 362/249.02; 362/101; 52/570

(58) Field of Classification Search

CPC ..... F21Y 2101/02; F21Y 2101/025; F21Y 2105/001; F21Y 2111/00; F21K 9/00; F21V 23/06; F21V 33/006; E04C 2/20; E04C 2/326

USPC ..... 362/249.02, 382, 311.01, 311.03, 800, 362/806, 362, 249.01, 101, 318, 317, 362/311.02; 52/284, 570, 574, 604, 605, 52/793.1; 215/10, 383

See application file for complete search history.

(56) References Cited

U.S. PATENT DOCUMENTS

| | | | | |
|---|---|---|---|---|
| 4,193,241 A | | 3/1980 | Jensen | |
| 5,503,288 A | * | 4/1996 | Conconi | 220/4.21 |
| 5,617,691 A | * | 4/1997 | Yamamoto | 52/604 |
| 5,901,520 A | * | 5/1999 | Abdul-Baki | 52/592.6 |
| 6,276,549 B1 | * | 8/2001 | Fasci et al. | 220/23.4 |
| 6,575,320 B2 | * | 6/2003 | Ota et al. | 215/381 |
| 7,413,081 B2 | * | 8/2008 | Rogers | 206/509 |

(Continued)

FOREIGN PATENT DOCUMENTS

| | | |
|---|---|---|
| CN | 2641186 Y | 9/2004 |
| JP | 200096580 | 4/2000 |

(Continued)

*Primary Examiner* — Nimeshkumar Patel
*Assistant Examiner* — Glenn Zimmerman
(74) *Attorney, Agent, or Firm* — Winston Hsu; Scott Margo

(57) ABSTRACT

A building material whereinside an accommodating space is formed is disclosed. The building material includes a first area whereon at least one protruding part and at least one sunken part are formed alternately in a first direction, and a second area whereon at least one protruding part and at least one sunken part are formed alternately in the first direction. The protruding part of the second area aligns with the corresponding sunken part of the first area in a second direction substantially perpendicular to the first direction, and the sunken part of the second area aligns with the corresponding protruding part of the first area in the second direction.

57 Claims, 8 Drawing Sheets

(56) References Cited

U.S. PATENT DOCUMENTS

| | | | | |
|---|---|---|---|---|
| 7,429,144 | B1 * | 9/2008 | Lai | 404/40 |
| 7,520,399 | B2 * | 4/2009 | Lane et al. | 215/10 |
| 8,210,734 | B2 * | 7/2012 | Wu | 362/647 |
| 2003/0075521 | A1 * | 4/2003 | Miura | 215/384 |
| 2004/0004829 | A1 * | 1/2004 | Policappelli | 362/101 |
| 2007/0122590 | A1 * | 5/2007 | Lalvani | 428/136 |
| 2008/0239704 | A1 * | 10/2008 | Lin | 362/101 |
| 2010/0308043 | A1 * | 12/2010 | Wimmer | 220/23.4 |
| 2012/0000921 | A1 * | 1/2012 | Mast et al. | 220/608 |

FOREIGN PATENT DOCUMENTS

| | | |
|---|---|---|
| TW | 177582 | 1/1992 |
| TW | 527460 | 4/2003 |
| TW | M332109 | 5/2008 |

* cited by examiner

BUILDING MATERIAL AND BUILT-UP BUILDING MATERIAL STRUCTURE

BACKGROUND OF THE INVENTION

1. Field of the Invention

The present invention relates to a building material and a built-up building material structure, and more particularly, to a building material and a built-up building material structure formed by a plurality of building materials embedded with each other.

2. Description of the Prior Art

A traditional building often utilizes cement as a building material of the building structure, such as a wall, a ceiling, a floor, and so on. The cement is a kind of building material made of limestone and clay mineral. Although the cement is utilized widespread, it has disadvantages of expensive mining cost of the limestone, serious pollution in the manufacturing process, and destruction to the natural surrounding due to mineral fields. In addition, surrounding temperature of the earth is increased gradually, but heat isolation of the traditional cement wall is worse so that indoor temperature of the traditional buildings can not decreased effectively. While manufacturers popularize to plant vegetation on an external side of the traditional cement wall so as to isolate the heat emitted from sunlight, the cement wall covered by the vegetation spends additional manufacturing cost. Thus, design of the building material structure having low cost, high heat isolation, and low pollution in the manufacturing process is an important issue in the building industry.

SUMMARY OF THE INVENTION

The present invention provides a building material and a built-up building material structure for solving above drawbacks.

According to the claimed invention, a building material whereinside an accommodating space is formed is disclosed. The building material includes a first area whereon at least one protruding part and at least one sunken part are formed alternately in a first direction, and a second area whereon at least one protruding part and at least one sunken part are formed alternately in the first direction. The protruding part of the second area aligns with the corresponding sunken part of the first area in a second direction substantially perpendicular to the first direction, and the sunken part of the second area aligns with the corresponding protruding part of the first area in the second direction.

According to the claimed invention, a built-up building material structure includes a first building material wherein-side an accommodating space is formed, and a second building material whereinside an accommodating space is formed. The first building material includes a first area whereon at least one protruding part and at least one sunken part are formed alternately in a first direction, and a second area whereon at least one protruding part and at least one sunken part are formed alternately in the first direction. The protruding part of the second area aligns with the corresponding sunken part of the first area in a second direction substantially perpendicular to the first direction, and the sunken part of the second area aligns with the corresponding protruding part of the first area in the second direction. The second building material includes a third area whereon at least one protruding part and at least one sunken part are formed alternately in the first direction, and a fourth area whereon at least one protruding part and at least one sunken part are formed alternately in the first direction. The protruding part of the fourth area aligns with the corresponding sunken part of the third area in the second direction, and the sunken part of the fourth area aligns with the corresponding protruding part of the third area in the second direction. The protruding parts and the sunken parts of the third area and the fourth area of the second building material are respectively wedged with the corresponding sunken parts and the corresponding protruding parts of the first area and the second area of the first building material.

According to the claimed invention, a built-up building material structure includes a first building material combination and a second building material combination wedged with the first building material combination. The first building material combination includes a plurality of first building materials and a plurality of second building materials. An accommodating space is formed inside each first building material. At least one protruding part and at least one sunken part are formed alternately on the first building material in a first direction, and the protruding part aligns with the corresponding sunken part in a second direction substantially perpendicular to the first direction. An accommodating space is formed inside each second building material. At least one protruding part and at least one sunken part are formed alternately on the second building material in the first direction, and the protruding part aligns with the corresponding sunken part in the second direction. The protruding part and the sunken part of the plurality of second building materials are respectively wedged with the corresponding sunken part and the corresponding protruding part of the plurality of first building materials. The second building material combination includes a plurality of third building materials and a plurality of fourth building materials. An accommodating space is formed inside each third building material. At least one protruding part and at least one sunken part are formed alternately on the third building material in the first direction, and the protruding part aligns with the corresponding sunken part in the second direction. An accommodating space is formed inside each fourth building material. At least one protruding part and at least one sunken part are formed alternately on the fourth building material in the first direction, and the protruding part aligns with the corresponding sunken part in the second direction. The protruding part and the sunken part of the plurality of fourth building material are respectively wedged with the corresponding sunken part and the corresponding protruding part of the plurality of third building materials. The plurality of first building materials and the plurality of second building materials of the first building material combination are wedged with the plurality of corresponding third building materials and the plurality of corresponding fourth building materials of the second building material combination.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
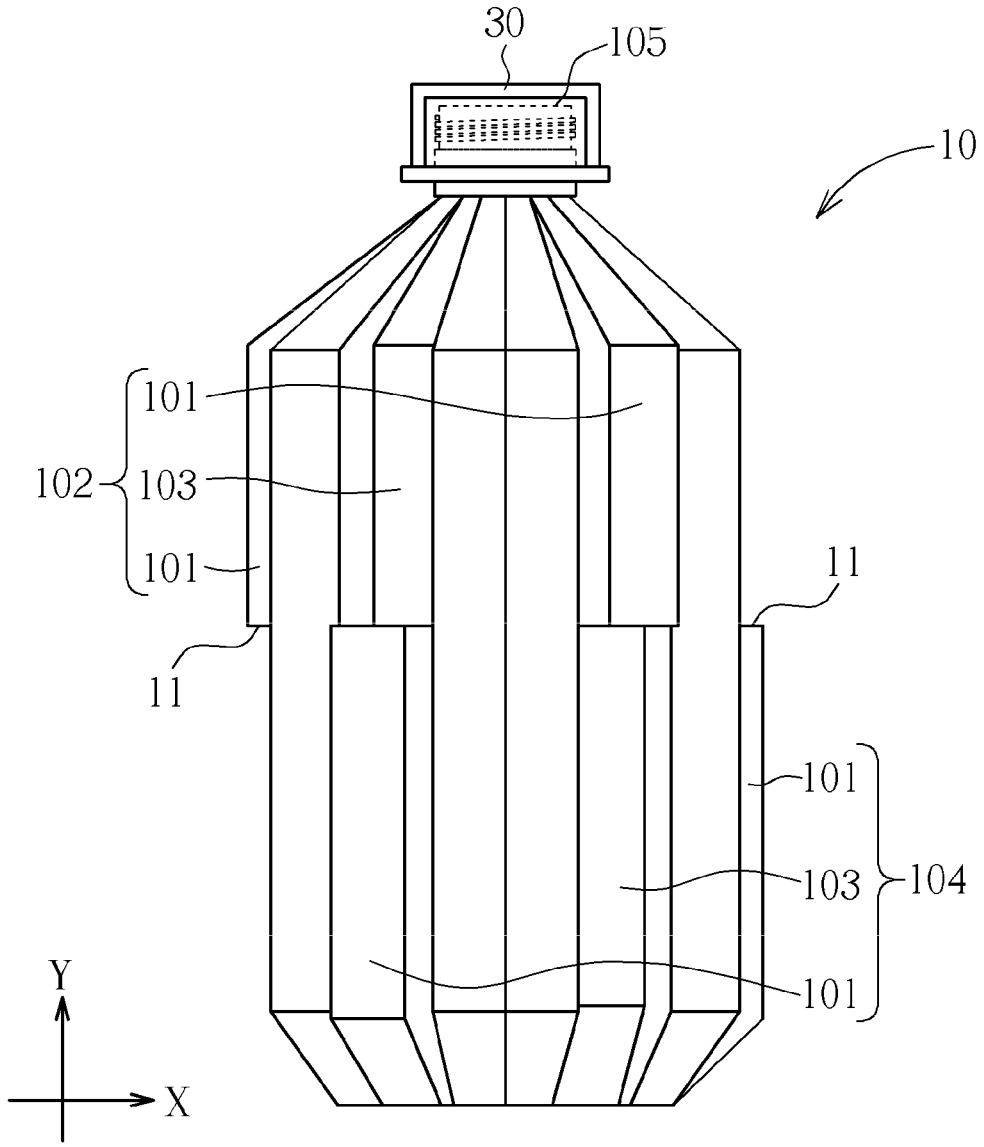
FIG. 1 is a diagram of a first building material according to a preferred embodiment of the present invention.
Figure 2:
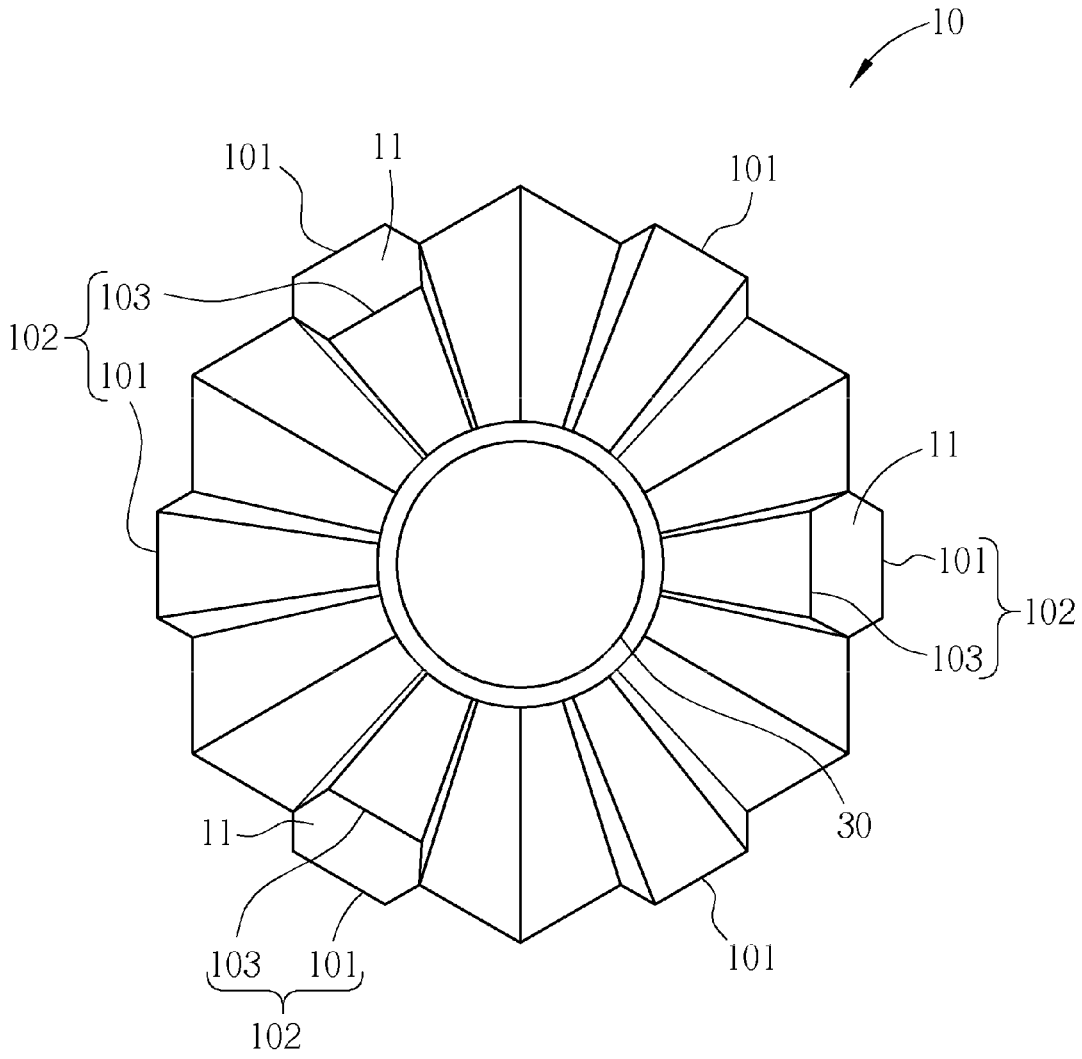
FIG. 2 is a top view of the first building material according to the preferred embodiment of the present invention.
Figure 3:
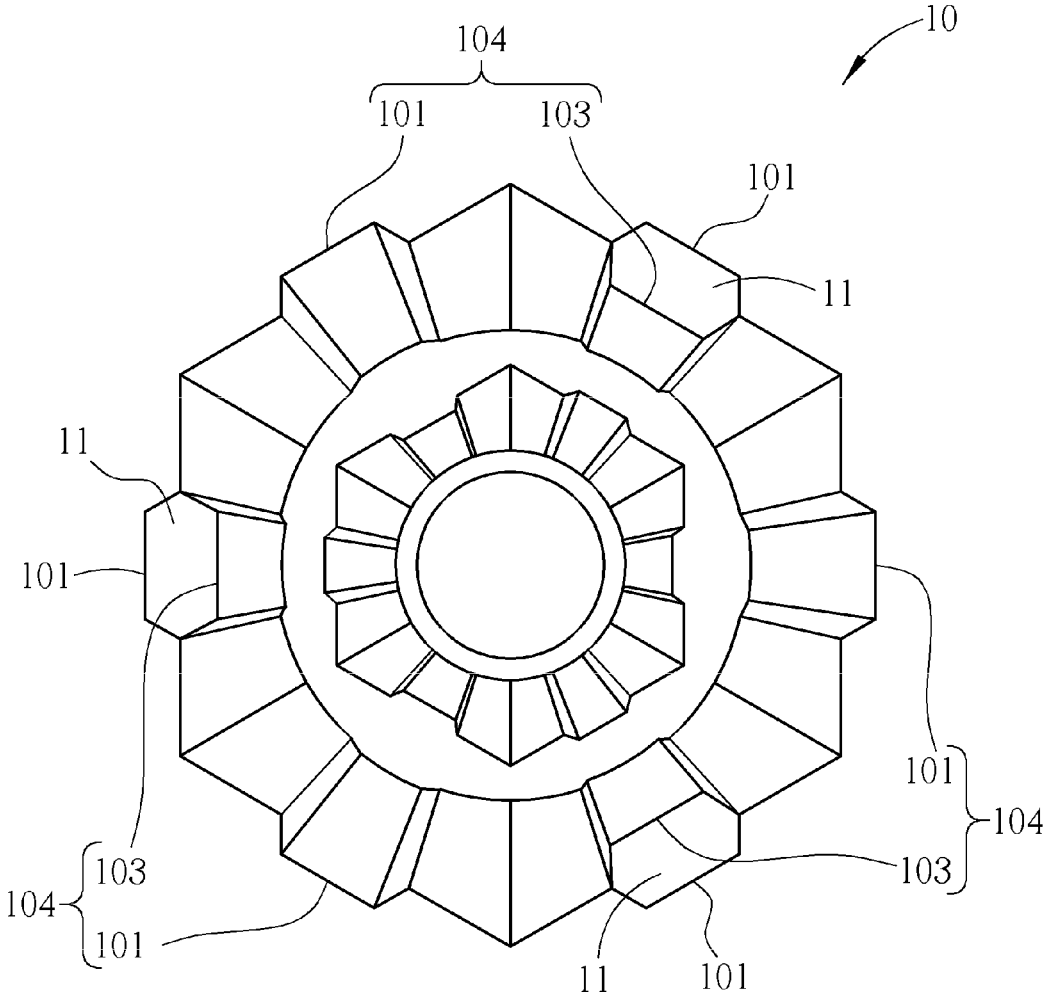
FIG. 3 is a bottom view of the first building material according to the preferred embodiment of the present invention.
Figure 4:
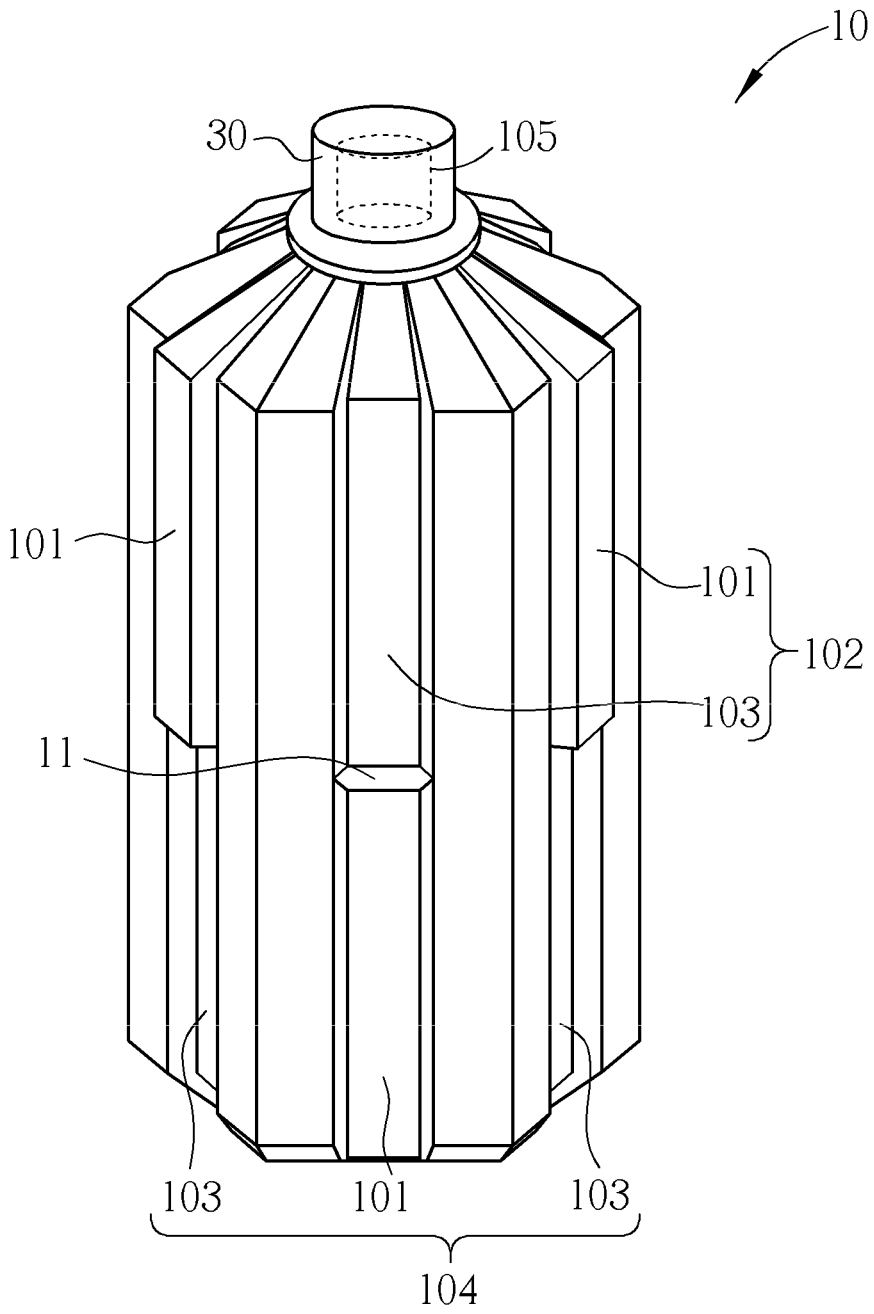
FIG. 4 is a drawing of the first building material according to the preferred embodiment of the present invention.

Please refer to FIG. 1 to FIG. 4. FIG. 1 is a diagram of a first building material 10 according to a preferred embodiment of the present invention. FIG. 2 is a top view of the first building material 10 according to the preferred embodiment of the present invention. FIG. 3 is a bottom view of the first building material 10 according to the preferred embodiment of the present invention. FIG. 4 is a perspective drawing of the first building material 10 according to the preferred embodiment of the present invention. An accommodating space is formed inside the first building material 10, which means the first building material 10 can be a hollow structural component. The first building material 10 can be a polygonal structure, such as a hexagon structure. The first building material 10 includes a first area 102 and a second area 104. At lease one protruding part 101 and at least one sunken part 103 are formed on the first area 102 alternately in a first direction (X direction), and at least one protruding part 101 and at least one sunken part 103 are formed on the second area 104 alternately in the first direction (X direction). An angle of 90 degrees (or any other angles) can be substantially formed between a lateral side of the protruding part 101 of the first area 102 and a bottom side of the corresponding sunken part 103 of the second area 104.

The protruding part 101 of the second area 104 aligns with the corresponding sunken part 103 of the first area 102 in a second direction (Y direction) substantially perpendicular to the first direction. Therefore, an upper edge of the protruding part 101 of the second area 104 connects with a lower edge of the corresponding sunken part 103 of the first area 102, so as to form a horizontal flange 11. Similarly, the sunken part 103 of the second area 104 aligns with the corresponding protruding part 101 of the first area 102 in the second direction (Y direction), and an upper edge of the sunken part 103 of the second area 104 connects with a lower edge of the corresponding protruding part 101 of the first area 102, so as to form the horizontal flange 11. The horizontal flange 11 which is a plane stretching from the first building material 10 outwardly has a function of shear stud for increasing shearing resistance when the first building materials 10 are combined to form a building material structure, so as to strengthen strength of the building material structure. In this embodiment, the horizontal flange 11 is disposed on a center of the first building material 10 preferably. The horizontal flange 11 can also be disposed on positions adjacent to two ends of the first building material 10 according to design demand, such as a position adjacent to an upper end or a lower end. In addition, the horizontal flange 11 can include a plurality of flange structural components. That means the first building material 10 also can include multi-layer areas besides the first area 102 and the second area 104. The protruding part 101 and the adjacent sunken part 103 of each area are disposed alternately in the first direction (X direction), and the protruding part 101 and the sunken part 103 of the adjacent areas are disposed alternately in the second direction (Y direction). The number and position of the horizontal flange 11 are not limited to the above-mentioned embodiment and depend on actual demand. The first building material 10 further includes an opening 105 for connecting the accommodating space of the first building material 10. The first building material 10 further includes a cap 30 for capping the opening 105 of the first building material 10.

Figure 5:
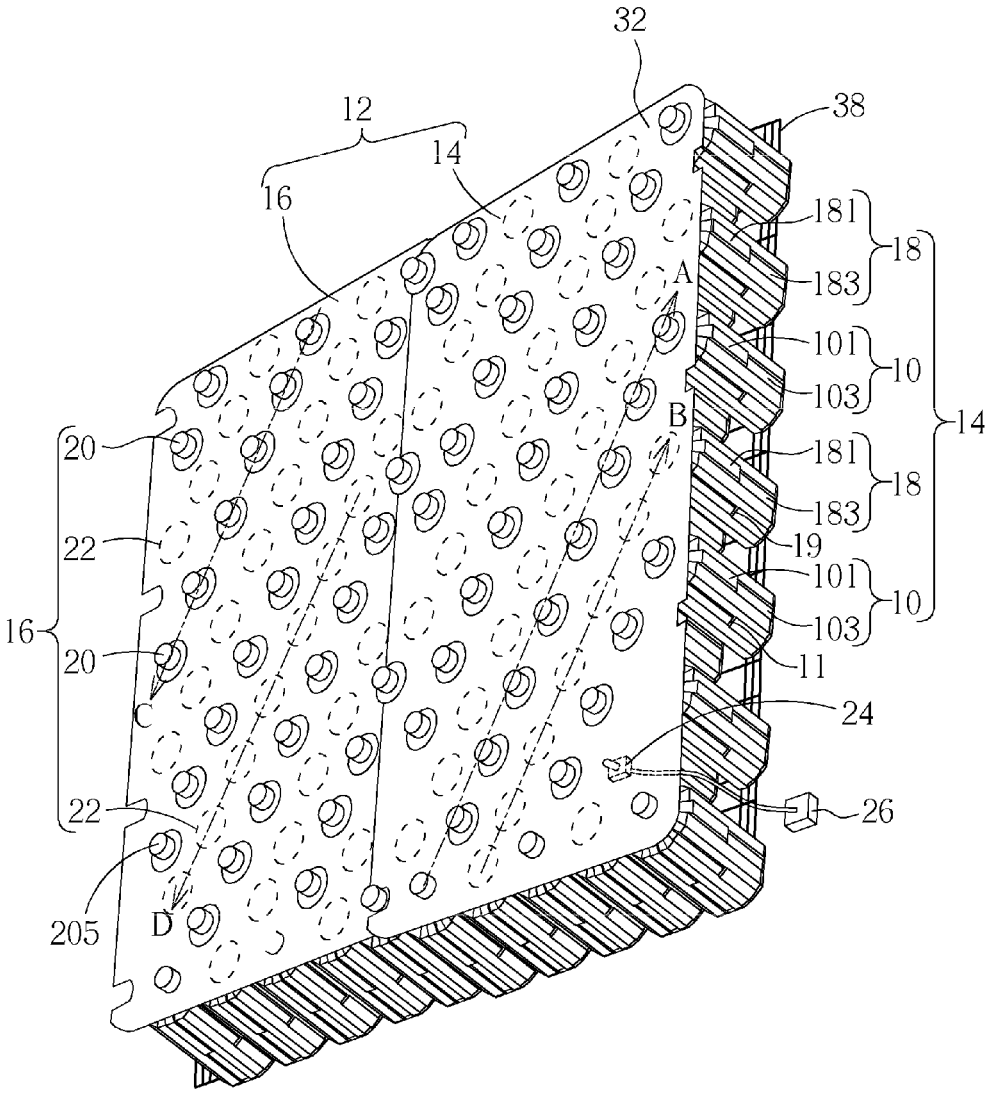
FIG. 5 is a diagram of a built-up building material structure according to the preferred embodiment of the present invention.

Please refer to FIG. 1 to FIG. 5. FIG. 5 is a diagram of a built-up building material structure 12 according to the preferred embodiment of the present invention. The built-up building material structure 12 includes a first building material combination 14 and a second building material combination 16. The second building material combination 16 is wedged with the first building material combination 14 so as to form a pre-stressed wall. The first building material combination 14 includes a plurality of first building materials 10 and a plurality of second building materials 18. A structure of the second building material 18 can be the same as a structure of the first building material 10. That is to say, at least one protruding part 181 and at least one sunken part 183 are formed alternately on the second building material 18 in the first direction (X direction), and the protruding part 181 and the sunken part 183 are formed alternately on the second building material 18 in the second direction (Y direction). In addition, a horizontal flange 19 is formed between the protruding part 181 and the sunken part 183 adjacent to the protruding part 181 in the second direction (Y direction). Function of the horizontal flange 19 is the same as the horizontal flange 11, and detailed description is omitted herein for simplicity. When the first building material 10 and the second building material 18 are combined with each other, the protruding part 101 and the sunken part 103 of the first building material 10 are wedged with the corresponding sunken part 183 and the corresponding protruding part 181 of the second building material 18, and the horizontal flange 11 of the first building material 10 contacts with the horizontal flange 19 of the second building material 18 tightly, so that the first building material 10 can be wedged with the corresponding second building material 18 in a tight fit manner. Therefore, the first building material combination 14 can have preferable shearing resistance strength because of a tight fit connection of the horizontal flange 11 of the first building material 10 and the horizontal flange 19 of the second building material 18.

Similar to the first building material combination 14, the second building material combination 16 includes a plurality of third building materials 20 and a plurality of fourth building materials 22. Shapes of the third building material 20 and the fourth building material 22 are the same as shapes of the first building material 10 and the second building material 18, so that structures and functions of each third building material 20 and each fourth building material 22 are the same as ones of the first building material 10 and the second building material 18, and detailed description is omitted herein for simplicity. Protruding parts and sunken parts of the plurality of fourth building materials 22 are wedged with corresponding sunken parts and corresponding protruding parts of the plurality of third building materials 20 tightly, respectively, so that the fourth building material 22 can be wedged with the third building material 20 in the tight fit manner so as to form the second building material combination 16 having the preferable shearing resistance strength. In addition, the plurality of first building materials 10 and the plurality of second building materials 18 of the first building material combination 14 are wedged with the corresponding third building materials 20 and the corresponding fourth building materials 22 of the second building material combination 16, respectively, so as to form the built-up building material structure 12. Thus, the protruding parts and the sunken parts of the building materials are wedged with one another for forming the built-up building material structure 12, and the horizontal flanges of the building materials contacts with each other so as to strengthen the shearing resistance strength of the built-up building material structure 12.

As shown in FIG. 5, the plurality of openings 105 of the plurality of first building materials 10 is arranged in a first inclined line A, and the plurality of openings 185 (shown in FIG. 6) of the plurality of second building materials 18 is arranged in a second inclined line B. Directions of the openings 105 of the first building materials 10 can be identical to or opposite to directions of the openings 185 of the second building materials 18, and the first inclined line A and the second inclined line B can be arranged alternately. For example, when the built-up building material structure 12 is designed as the pre-stressed wall, the directions of the openings 105 of the first building material 10 can be opposite to the directions of the openings 185 of the second building material 18, and the first inclined line A and the second inclined line B are substantially arranged alternately in parallel. When the build-up building material structure 12 is designed for decoration or partition, the directions of the openings 105 of the first building material 10 can be identical with the directions of the openings 185 of the second building material 18. In addition, a plurality of openings 205 of the plurality of third building materials 20 is arranged in a third inclined line C, and a plurality of openings 225 (shown in FIG. 6) of the plurality of fourth building materials 22 is arranged in a fourth inclined line D. Directions of the openings 205 of the third building material 20 and the openings 225 of the fourth building material 22 are designed according to design demand, and the third inclined line C and the fourth inclined line D can be substantially arranged alternately in parallel.

Besides, as shown in FIG. 5, the build-up building material structure 12 can further include at least one light source 24 disposed on a side of the first building material combination 14 or a side of the second building material combination 16. The light source 24 can further be disposed inside the accommodating space of the first building material combination 14 or the second building material combination 16 selectively. The light source 24 can be electrically connected to a power supply 26 to receive electricity. The light source 24 can be selected from a group consisting of a light emitting diode (LED), a laser LED, a light bulb, and combination thereof. The number and position of the light source 24 are not limited to the above-mentioned embodiment and depend on design demand. The build-up building material structure 12 can further include a refractive medium disposed inside the accommodating spaces of the plurality of first building materials, the plurality of second building materials, the plurality of third building materials, or the plurality of fourth building materials. The refractive medium can be for refracting light emitted from the light source 24. The refractive medium can be liquid, such as transparent water or opaque liquid, so as to vary the light according to fluidity of the liquid. Thus, the light emitted from the light source 24 can be refracted by the refractive medium so that the build-up building material structure 12 can be viewed gloriously. The build-up building material structure 12 can further be a street lamp for lightening at night. The cap 30 can be for capping the openings of the building material of the build-up building material structure 12 so as to hold the refractive medium inside each building material.

Figure 6:
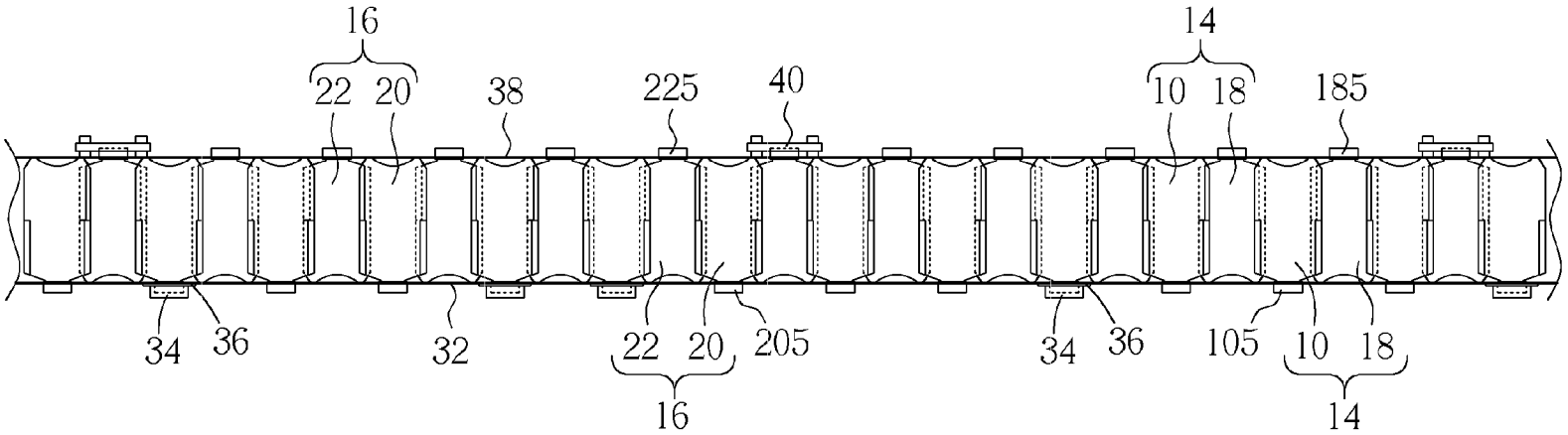
FIG. 6 is a side view of the build-up building material structure according to the preferred embodiment of the present invention.

Please refer to FIG. 6. FIG. 6 is a lateral view of the build-up building material structure 12 according to the preferred embodiment of the present invention. The build-up building material structure 12 can further include at least one covering component 32 disposed on an end of the first building material 14 and an end of the second building material 16. The adjacent covering components 32 are disposed on the end of the first building material 14 and the end of the second building material 16 in an overlapped manner. A plurality of holes is formed on the covering component 32 for holding the plurality of openings 105 of the plurality of first building materials 10, the plurality of openings 185 of the plurality of second building materials 18, the plurality of openings 205 of the plurality of third building materials 20, or the plurality of openings 225 of the plurality of fourth building materials 22. Besides, an optical thin film can be formed on a side of the covering component 32 for isolating heat and ultraviolet rays. The build-up building material structure 12 can further include a fixing component 34 for fixing the covering component 32 on the end of the first building material 14 or the end of the second building material 16. The build-up building material structure 12 can further include a cushion 36 disposed between the fixing component 34 and the covering component 32 for preventing liquid from leaking into a gap between the fixing component 34 and the covering component 32. The fixing component 34 can be an annular protrusion. For example, the fixing component 34 can be a bottle cap. As the fixing component 34 is the bottle cap, the fixing component 34 can replace the cap 30, which means the fixing component 34 can cap the openings of the building material. Thus, the fixing component 34 not only can fix the covering component 32 on the end of the first building material 14 or the end of the second building material 16, but also can prevent the refractive medium in the accommodating space of each building material from leaking. The covering component 32 can be made of polyvinyl chloride material. The cushion 36 can be made of rubber material.

As shown in FIG. 5 and FIG. 6, the build-up building material structure 12 can further include at least one reinforcing component 38 disposed on the other end of the first building material 14 or the other end of the second building material 16 for reinforcing the first building material 14 and the second building material 16. That is to say, the reinforcing component 38 and the covering component 32 can be disposed on two ends of the build-up building material structure 12, respectively. The build-up building material structure 12 can further include a bridging component 40 for bridging the adjacent reinforcing components 38 disposed on the end of the first building material 14 and the end of the second building material 16, so as to connect the first building material 14 and the second building material 16 tightly. The covering component 32 and the reinforcing component 38 can be disposed on the two ends of the build-up building material structure 12 simultaneously for strengthening the strength of the build-up building material structure 12. Further, the covering component 32 and the reinforcing component 38 can be the identical structural components. The structural components capable of being disposed on the end of the build-up building material structure 12 for increasing the strength of the build-up building material structure 12 belong to the scope of the covering component 32 and the reinforcing component 38 of the build-up building material structure 12 of the present invention.

The covering component 32 and the reinforcing component 38 can be for increasing the shearing resistance strength of the build-up building material structure 12, so that the build-up building material structure 12 not only can be the pre-stressed wall, but also can be a suspended flat, such as an eaves and a canopy. Furthermore, the strength of the build-up building material structure 12 can also be increased by other means. For example, the accommodating spaces of the building materials on the lower layer of the build-up building material structure 12 can be full of heavy objects, such as water and sand, to increase weight of the building materials on the lower layer of the build-up building material structure 12, so that the build-up building material structure 12 can have the preferable shearing resistance strength. Thus, the above-mentioned build-up building material structure 12 can be the decoration wall or the partition wall without the auxiliary covering component 32 and the auxiliary reinforcing component 38. The build-up building material structure 12 shown in FIG. 5 is just a preferred embodiment of the pre-stressed wall. When the plurality of building materials is combined to form the decoration wall or the partition wall, which does not need greater shearing resistance strength, the openings of the plurality of building materials can be disposed in the same direction so as to form the build-up building material structure 12 of the present invention for artistry and convenience.

Figure 7:
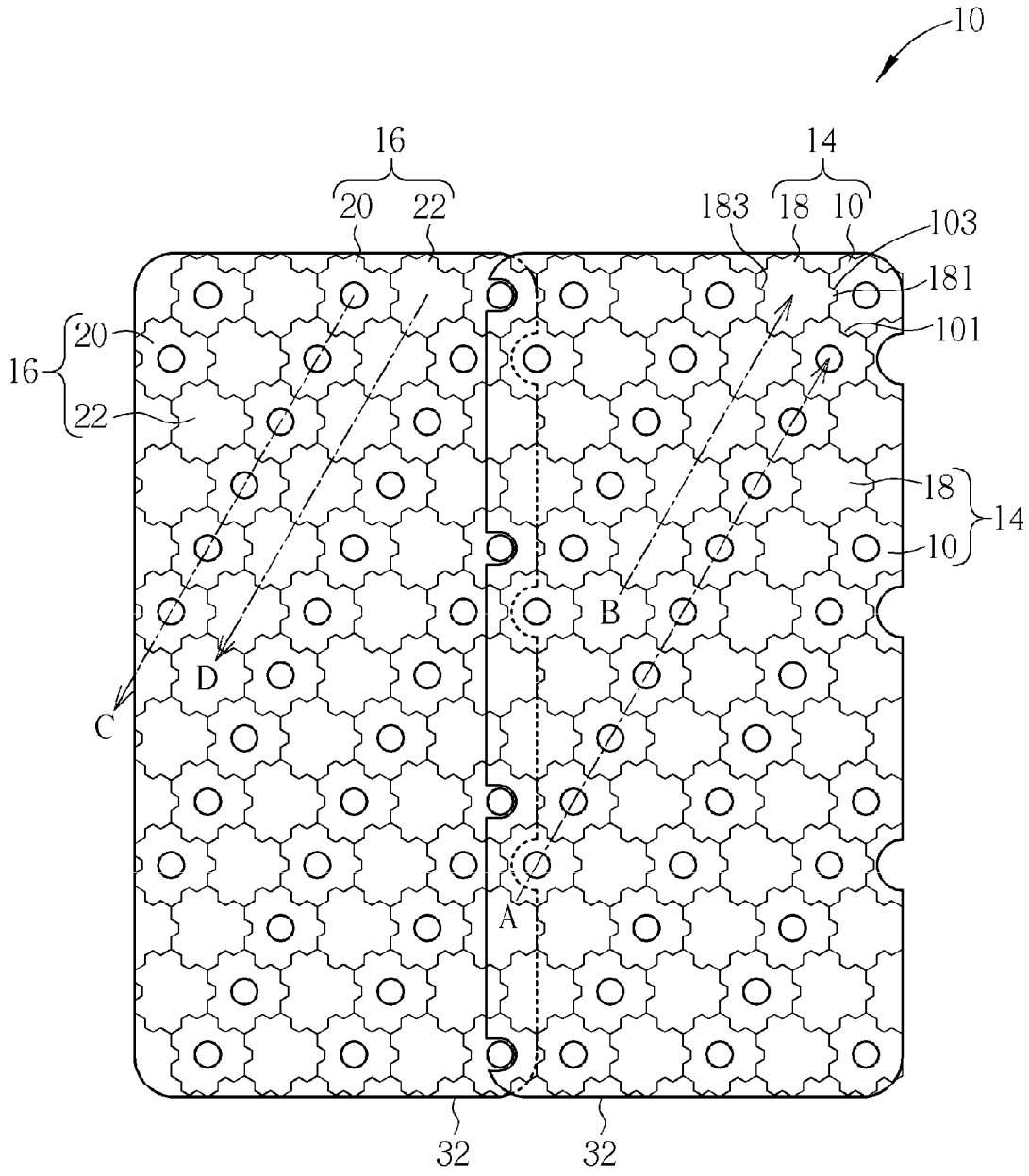
FIG. 7 is a front view of the build-up building material structure according to the preferred embodiment of the present invention.

Please refer to FIG. 7. FIG. 7 is a front view of the build-up building material structure 12 according to the preferred embodiment of the present invention. The protruding parts 181 and the sunken parts 183 of the plurality of second building materials 18 are respectively wedged with the corresponding sunken parts 103 and the corresponding protruding parts 101 of the plurality of first building materials 10, and the horizontal flanges 19 of the plurality of second building materials 18 contact with the corresponding horizontal flanges 11 of the plurality of first building materials 10, so as to increase the shearing resistance strength of the first building material combination 14. Similarly, the protruding parts and the sunken parts of the plurality of fourth building materials 22 are respectively wedged with the corresponding sunken parts and the corresponding protruding parts of the plurality of third building materials 20, and horizontal flanges of the plurality of third building materials 20 contact with corresponding horizontal flanges of the plurality of fourth building materials 22, so as to increase the shearing resistance strength of the second building material combination 16. Besides, the plurality of first building materials 10 and the plurality of second building materials 18 of the first building material combination 14 are wedged with the corresponding third building materials 20 and the corresponding fourth building materials 22 of the second building material combination 16, and the horizontal flanges of the first building material combination 14 contact with the corresponding horizontal flanges of the second building material combination 16, so as to form the build-up building material structure 12 having preferable shearing resistance strength. As shown in FIG. 7, the adjacent covering component 32 of the build-up building material structure 12 can be disposed on the end of the first building material combination 14 and the end of the second building material combination 16 in the overlapped manner. The first inclined line A and the second inclined line B are arranged alternately, and the third inclined line C and the fourth inclined line D are arranged alternately.

Figure 8:
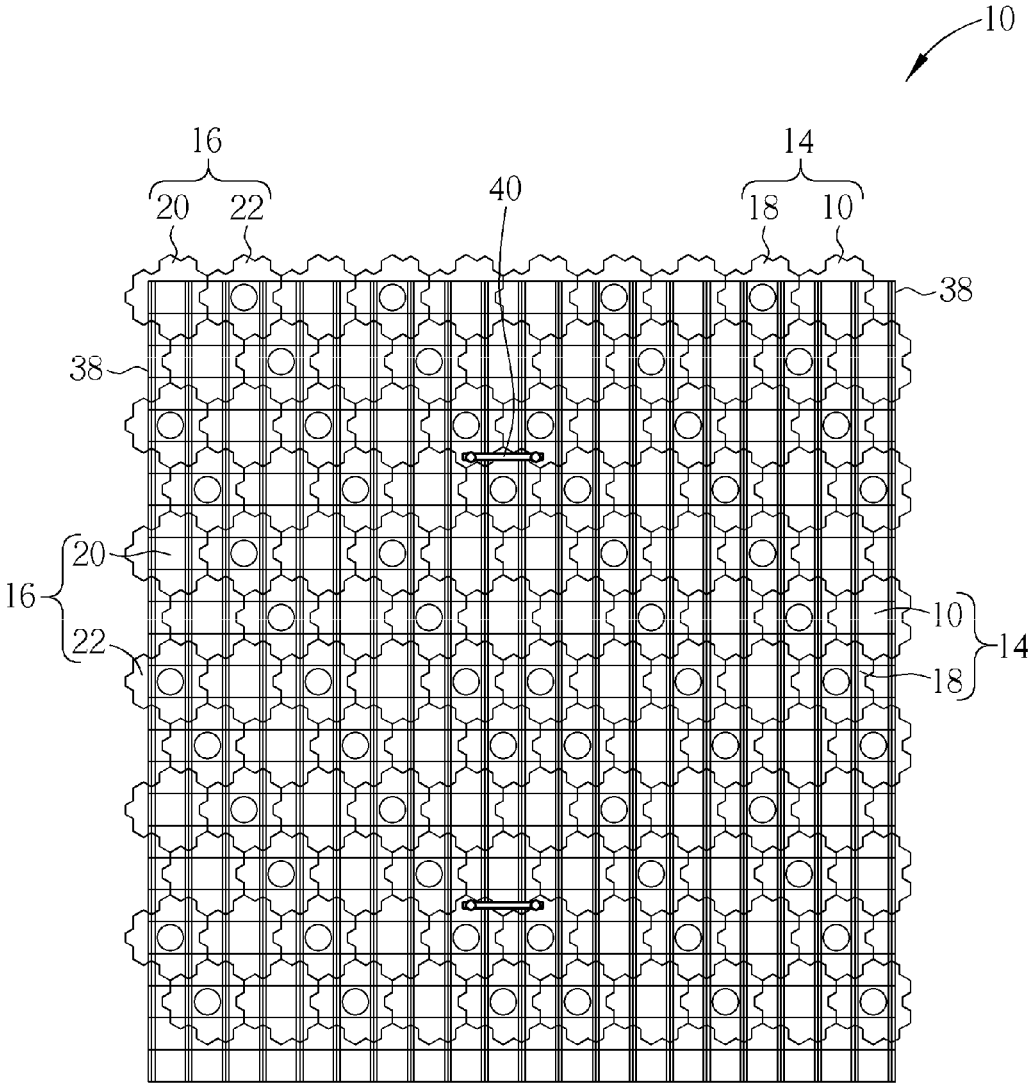
FIG. 8 is a back view of the build-up building material structure according to the preferred embodiment of the present invention.

Please refer to FIG. 8. FIG. 8 is a back view of the build-up building material structure 12 according to the preferred embodiment of the present invention. The reinforcing component 38 is disposed on the other end of the first building material combination 14 and the other end of the second building material combination 16. The reinforcing component 38 can be a structural component having holes, such as a meshed structural component. The reinforcing component 38 can be made of metal material. Generally, the ends of the plurality of first building materials 10 directing to the reinforcing component 38 or the ends of the plurality of second building materials 18 directing to the reinforcing component 38 are respectively inserted into the holes on the structural component so as to increase lateral shearing resistance strength of the first building material combination 14, and the ends of the plurality of third building materials 20 directing to the reinforcing component 38 and the ends of the plurality of fourth building materials 18 directing to the reinforcing component 38 are respectively inserted into the holes on the structural component so as to increase lateral shearing resistance strength of the second building material combination 16. Besides, the present invention further includes the bridging component 40 for connecting the adjacent reinforcing components 38 disposed on the first building material combination 14 and the second building material combination 16 so as to improve stability of the build-up building material structure 12. As shown in FIG. 6, FIG. 7, and FIG. 8, the reinforcing component 38 and the covering component 32 can be fixed on the two sides of the build-up building material structure 12, respectively. For example, the side of the build-up building material structure 12 exposed outdoors can be covered by the covering component 32, the accommodating space of the building material can be for isolating the heat, and the covering component 32 can be for isolating the heat and the ultraviolet rays. The covering component 32 can further have functions of scrape-proofing and water-proofing, so that the build-up building material structure 12 has longer operating life. The reinforcing component 38 disposed on the other side of the build-up building material structure 12 indoors can hold the openings of the building materials into the holes on the reinforcing component 38. Dispositions of the covering component 32 and the reinforcing component 38 are not limited to the above-mentioned embodiment, for example, the covering component 32 and the reinforcing component 38 can be utilized selectively, and depend on actual demand. Besides, the build-up building material structure 12 can be utilized with the conventional building material, such as a ferroconcrete structure, and depends on design demand.

Detailed description of assembly of the first building material combination 14 is introduced as follows. A user can put the refractive medium into the plurality of first building materials 10 or the plurality of second building materials 18 via the openings of each building material, and cap the cap 30 on the opening of each building material for preventing the refractive medium from leaking from the accommodating space of each building material. The user can further dispose the light source 24 on the lateral sides of the first building material 10 or the second building material 18, so that the refractive medium can refract the light emitted from the light source 24 and the first building material combination 14 artistically. Then, the plurality of openings 105 of the plurality of first building materials 10 covered by the caps 30 and the plurality of openings 185 of the plurality of second building materials 18 covered by the caps 30 are selectively held into the plurality of holes on the covering component 32. The cushion 36 is disposed between the covering component 32 and the fixing component 34, and the user can utilize the fixing component 34 to fix the cushion 36 and the covering component 32 on the first building material combination 14, so that the first building material combination 14 has preferred functions of water-proofing, heat isolation, ultraviolet rays isolation, and the shearing resistance strength. In addition, the cap 30 can be omitted to cap on the corresponding opening of the building material. The user can utilize the fixing component 34 to fix on the opening of the corresponding building material, which means the fixing component 34 can cap the opening of the building material and can also fix the cushion 35 and the covering component 32 on the first building material combination 14, simultaneously. The user can further dispose the reinforcing component 38 on the other side the of the first building material combination 14, so as to increase the shearing resistance strength of the first building material combination 14.

Similarly, the user can wedge the plurality of third building materials 20 with the plurality of fourth building materials 22 so as to form the second building material combination 16 in the same process, and can wedge the first building material combination 14 with the second building material combination 16 so as to form the built-up building material structure 12. In order to increase the stability of the built-up building material structure 12, the user can overlap the adjacent covering components 32 on the sides of the first building material combination 14 and the second building material combination 16, so as to connect the adjacent building material combination stably. The user can further utilize the bridging component 40 to connect the adjacent reinforcing components 38 disposed on the other sides of the first building material combination 14 and the second building material combination 16 tightly, so as to increase the shearing resistance strength of the built-up building material structure 12. Thus, dimensions of the built-up building material structure 12 can be adjusted according to actual demand.

In conclusion, the first building material 10, the second building material 18, the third building material 20, and the fourth building material 22 of the present invention are the structural components having identical polygonal shape. The user can wedge the plurality of first building materials 10 with the plurality of second building materials 18 so as to form the first building material combination 14, wedge the plurality of third building materials 20 with the plurality of fourth building materials 22 so as to form the second building material combination 16, and wedge the first building material combination 14 with the second building material combination 16 so as to form the built-up building material structure 12 easily and conveniently. The user can further wedge the other building material combination into the built-up building material structure 12 so as to expand the dimensions of the built-up building material structure, such as expanding transverse dimension or vertical dimension. The assembly process of expanding the built-up building material structure is the same as the above-mentioned embodiment, and detailed description is omitted herein for simplicity.

Comparing to the prior art, the build-up building material structure of the present invention is assembled easily, so that the present invention can economize labor hours and improve difficulty of assembly. The accommodating space of the building material can isolate the heat effectively. The refractive medium filled inside the accommodating space can refract the light emitted from the light source, so that the build-up building material structure can be showed artistically. In addition, the build-up building material structure of the present invention can utilize discarded plastic bottles, which had been recycled and processed, to manufacture the building material so as to form the build-up building material structure having low manufacturing cost. The build-up building material structure of the present invention not only can decrease pollution in manufacturing process, but also can prevent ecological environment from polluting.

Those skilled in the art will readily observe that numerous modifications and alterations of the device and method may be made while retaining the teachings of the invention.

What is claimed is:

1. A built-up building material structure comprising:

a first building material whereinside an accommodating space is formed, the first building material comprising:

a first bottle-shaped body comprising a first annular lateral surface, a first top end and a first bottom end, the first top end and the first bottom end being respectively connected to two edges of the first annular lateral surface;

a first area whereon at least one protruding part and at least one sunken part are formed alternately in a first direction, the first area being disposed on an upper side of the first annular lateral surface; and a second area whereon at least one protruding part and at least one sunken part are formed alternately in the first direction, the second area being disposed on a low side of the first annular lateral surface, the protruding part of the second area aligning with the corresponding sunken part of the first area in a second direction substantially perpendicular to the first direction, and the sunken part of the second area aligning with the corresponding protruding part of the first area in the second direction;

a second building material whereinside an accommodating space is formed, the second building material comprising:

a second bottle-shaped body comprising a second annular lateral surface, a second top end and a second bottom end, the second top end and the second bottom end being respectively connected to two edges of the second annular lateral surface;

a third area whereon at least one protruding part and at least one sunken part are formed alternately in the first direction, the third area being disposed on an upper side of the second annular lateral surface; and a fourth area whereon at least one protruding part and at least one sunken part are formed alternately in the first direction, the fourth area being disposed on a low side of the second annular lateral surface, the protruding part of the fourth area aligning with the corresponding sunken part of the third area in the second direction, and the sunken part of the fourth area aligning with the corresponding protruding part of the third area in the second direction; and a reinforcing component disposed on an end of the first building material and an end of the second building material for reinforcing the first building material and the second building material, the reinforcing component being a meshed structural component, and the end of the first building material and the end of the second building material being respectively inserted into meshes on the meshed structural component;

wherein the protruding parts and the sunken parts of the third area and the fourth area of the second building material are respectively wedged with the corresponding sunken parts and the corresponding protruding parts of the first area and the second area of the first building material.

2. The built-up building material structure of claim 1, wherein a lower edge of the protruding part of the first area connects with an upper edge of the corresponding sunken part of the second area so as to form a horizontal flange.

3. The built-up building material structure of claim 2, wherein the horizontal flange is substantially formed on a center of the first building material.

4. The built-up building material structure of claim 1, wherein a lower edge of the sunken part of the first area connects with an upper edge of the corresponding protruding part of the second area so as to form a horizontal flange.

5. The built-up building material structure of claim 4, wherein the horizontal flange is substantially formed on a center of the first building material.

6. The built-up building material structure of claim 1 further comprising:

a light source disposed on a side of the first building material or a side of the second building material, or disposed inside the accommodating space of the first building material or inside the accommodating space of the second building material.

7. The built-up building material structure of claim 6, wherein the light source is selected from a group consisting of a light emitting diode (LED), a laser LED, a light bulb, and combination thereof.

8. The built-up building material structure of claim 1 further comprising:

a refractive medium disposed inside the accommodating space of the first building material or the accommodating space of the second building material.

9. The built-up building material structure of claim 8, wherein the refractive medium is liquid.

10. The built-up building material structure of claim 1 further comprising:

a cap for capping an opening of the first building material or an opening of the second building material, the opening being connected to the accommodating space.

11. The built-up building material structure of claim 1 further comprising:

a covering component disposed on an end of the first building material and an end of the second building material.

12. The built-up building material structure of claim 11 further comprising:

a fixing component for fixing the covering component on the end of the first building material and the end of the second building material.

13. The built-up building material structure of claim 12 further comprising:

a cushion disposed between the fixing component and the covering component for preventing liquid from leaking into a gap between the fixing component and the covering component.

14. The built-up building material structure of claim 11, wherein a plurality of holes is formed on the covering component for holding an opening of the first building material and an opening of the second building material.

15. The built-up building material structure of claim 12, wherein the fixing component is an annular protrusion.

16. The built-up building material structure of claim 15, wherein the fixing component is a bottle cap.

17. The built-up building material structure of claim 11, wherein an optical thin film is formed on a side of the covering component for isolating heat or ultraviolet rays.

18. The built-up building material structure of claim 11, wherein the covering component is made of polyvinyl chloride.

19. The built-up building material structure of claim 13, wherein the cushion is made of rubber material.

20. The built-up building material structure of claim 1, wherein the reinforcing component is a structural component having holes, and the end of the first building material and the end of the second building material are respectively held inside the holes on the reinforcing component.

21. The built-up building material structure of claim 20, wherein the reinforcing component is made of metal material.

22. The built-up building material structure of claim 1, wherein the first building material is a polygonal building material.

23. The built-up building material structure of claim 22, wherein the first building material is a hexagon building material.

24. The built-up building material structure of claim 22, wherein a lateral side of the protruding part of the first area of the first building material is substantially perpendicular to a bottom side of the corresponding sunken part of the second area.

25. A built-up building material structure comprising:

a first building material combination comprising:

a plurality of first building materials, an accommodating space being formed inside each first building material, each first building material comprising a first bottle-shaped body, at least one protruding part and at least one sunken part being formed alternately on a first annular lateral surface of the first bottle-shaped body in a first direction, and the protruding part aligning with the corresponding sunken part in a second direction substantially perpendicular to the first direction; and a plurality of second building materials, an accommodating space being formed inside each second building material, each second building material comprising a second bottle-shaped body, at least one protruding part and at least one sunken part being formed alternately on a second annular lateral surface of the second bottle-shaped body in the first direction, and the protruding part aligning with the corresponding sunken part in the second direction; and wherein the protruding part and the sunken part of the plurality of second building materials are respectively wedged with the corresponding sunken part and the corresponding protruding part of the plurality of first building materials;

a second building material combination wedged with the first building material combination, the second building material combination comprising:

a plurality of third building materials, an accommodating space being formed inside each third building material, each third building material comprising a third bottle-shaped body, at least one protruding part and at least one sunken part being formed alternately on a third annular lateral surface of the third bottle-shaped body in the first direction, and the protruding part aligning with the corresponding sunken part in the second direction; and a plurality of fourth building materials, an accommodating space being formed inside each fourth building material, each fourth building material comprising a fourth bottle-shaped body, at least one protruding part and at least one sunken part being formed alternately on a fourth annular lateral surface of the fourth bottle-shaped body in the first direction, and the protruding part aligning with the corresponding sunken part in the second direction; and wherein the protruding part and the sunken part of the plurality of fourth building material are respectively wedged with the corresponding sunken part and the corresponding protruding part of the plurality of third building materials; and at least one reinforcing component disposed on an end of the first building material combination or an end of the second building material combination for reinforcing the first building material combination or the second building material combination, the reinforcing component being a meshed structural component, and each end of the plurality of first building materials, each end of the plurality of second building materials, each end of the plurality of third building materials, and each end of the plurality of fourth building materials being respectively inserted into meshes on the meshed structural component;

wherein the plurality of first building materials and the plurality of second building materials of the first building material combination are wedged with the plurality of corresponding third building materials and the plurality of corresponding fourth building materials of the second building material combination.

26. The built-up building material structure of claim 25, wherein each first building material comprises:

a first area whereon at least one protruding part and at least one sunken part are formed alternately in the first direction; and a second area whereon at least one protruding part and at least one sunken part are formed alternately in the first direction, the protruding part of the second area aligning with the corresponding sunken part of the first area in the second direction, and the sunken part of the second area aligning with the corresponding protruding part of the first area in the second direction.

27. The built-up building material structure of claim 25, wherein a lower edge of the protruding part of the first building material connects with an upper edge of the corresponding sunken part of the first building material so as to form a horizontal flange.

28. The built-up building material structure of claim 27, wherein the horizontal flange is substantially formed on a center of the first building material.

29. The built-up building material structure of claim 25, a lower edge of the sunken part of the first building material connects with an upper edge of the corresponding protruding part of the first building material so as to form a horizontal flange.

30. The built-up building material structure of claim 29, wherein the horizontal flange is substantially formed on a center of the first building material.

31. The built-up building material structure of claim 25 further comprising:

at least one light source disposed on a side of the first building material combination or a side of the second building material combination, or disposed inside the accommodating space of the first building material combination or the accommodating space of the second building material combination.

32. The built-up building material structure of claim 31, wherein the light source is selected from a group consisting of a light emitting diode (LED), a laser LED, a light bulb, and combination thereof.

33. The built-up building material structure of claim 25 further comprising:

a refractive medium disposed inside the accommodating space of the plurality of first building materials, the accommodating space of the plurality of second building materials, the accommodating space of the plurality of third building materials, or the accommodating space of the plurality of fourth building materials.

34. The built-up building material structure of claim 33, wherein the refractive medium is liquid.

35. The built-up building material structure of claim 25 further comprising:

a plurality of caps for respectively capping a plurality of openings of the plurality of first building materials, a plurality of openings of the plurality of second building materials, a plurality of openings of the plurality of third building materials, or a plurality of openings of the plurality of fourth building materials.

36. The built-up building material structure of claim 35, wherein the plurality of openings of the plurality of first building materials is arranged in a first inclined line, the plurality of openings of the plurality of second building materials is arranged in a second inclined line, and the first inclined line and the second inclined line are arranged alternately.

37. The built-up building material structure of claim 36, wherein directions of the plurality of openings of the plurality of first building materials are the same as directions of the plurality of openings of the plurality of second building materials.

38. The built-up building material structure of claim 36, wherein directions of the plurality of openings of the plurality of first building materials are opposite to directions of the plurality of openings of the plurality of second building materials.

39. The built-up building material structure of claim 36, wherein the plurality of openings of the plurality of third building materials is arranged in a third inclined line, the plurality of openings of the plurality of fourth building materials is arranged in a fourth inclined line, and the third inclined line and the fourth inclined line are arranged alternately.

40. The built-up building material structure of claim 39, wherein directions of the plurality of openings of the plurality of third building materials are the same as directions of the plurality of openings of the plurality of fourth building materials.

41. The built-up building material structure of claim 39, wherein directions of the plurality of openings of the plurality of third building materials are opposite to directions of the plurality of openings of the plurality of fourth building materials.

42. The built-up building material structure of claim 25 further comprising:

at least one covering component disposed on an end of the first building material combination or an end of the second building material combination.

43. The built-up building material structure of claim 42 further comprising:

a fixing component for fixing the covering component on the end of the first building material combination or the end of the second building material combination.

44. The built-up building material structure of claim 43 further comprising:

a cushion disposed between the fixing component and the covering component for preventing liquid from leaking into a gap between the fixing component and the covering component.

45. The built-up building material structure of claim 42, wherein a plurality of holes is formed on the covering component for holding the plurality of openings of the plurality of first building materials, the plurality of openings of the plurality of second building materials, the plurality of openings of the plurality of third building materials, and the plurality of openings of the plurality of fourth building materials.

46. The built-up building material structure of claim 42 further comprising:

a plurality of covering components, the adjacent covering components disposed on the end of the first building material combination and the end of the second building material combination being overlapped with each other.

47. The built-up building material structure of claim 43, wherein the fixing component is an annular protrusion.

48. The built-up building material structure of claim 47, wherein the fixing component is a bottle cap.

49. The built-up building material structure of claim 42, wherein an optical thin film is formed on a side of the covering component for isolating heat or ultraviolet rays.

50. The built-up building material structure of claim 42, wherein the covering component is made of polyvinyl chloride.

51. The built-up building material structure of claim 44, wherein the cushion is made of rubber material.

52. The built-up building material structure of claim 25 further comprising:

a bridging component for bridging the adjacent reinforcing components.

53. The built-up building material structure of claim 25, wherein the reinforcing component is a structural component having holes, and each end of the plurality of first building materials, each end of the plurality of second building materials, each end of the plurality of third building materials, and each end of the plurality of fourth building materials are respectively held inside the holes on the reinforcing component.

54. The built-up building material structure of claim 25, wherein the reinforcing component is made of metal material.

55. The built-up building material structure of claim 25, wherein the first building material is a polygonal building material.

56. The built-up building material structure of claim 55, wherein the first building material is a hexagon building material.

57. The built-up building material structure of claim 55, wherein a lateral side of the protruding part of the first building material is substantially perpendicular to a bottom side of the corresponding sunken part aligning with the protruding part in the second direction.

* * * * *